US012018413B2

(12) United States Patent
Charlas

(10) Patent No.: US 12,018,413 B2
(45) Date of Patent: Jun. 25, 2024

(54) CONTROL OF THE POSITIONING AND CONTINUITY OF THREADS IN A LOOM

(71) Applicant: SAFRAN AIRCRAFT ENGINES, Paris (FR)

(72) Inventor: Mathieu Julien Charlas, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 229 days.

(21) Appl. No.: 17/593,762

(22) PCT Filed: Mar. 16, 2020

(86) PCT No.: PCT/FR2020/050554

§ 371 (c)(1),
(2) Date: Sep. 24, 2021

(87) PCT Pub. No.: WO2020/193907

PCT Pub. Date: Oct. 1, 2020

(65) Prior Publication Data

US 2022/0170188 A1 Jun. 2, 2022

(30) Foreign Application Priority Data

Mar. 28, 2019 (FR) ..... 1903273

(51) Int. Cl.
*D03D 51/28* (2006.01)
*D03J 1/00* (2006.01)

(52) U.S. Cl.
CPC ..... *D03D 51/28* (2013.01); *D03J 1/007* (2013.01); *D03J 2700/06* (2013.01); *D10B 2101/12* (2013.01)

(58) Field of Classification Search
None
See application file for complete search history.

(56) References Cited

U.S. PATENT DOCUMENTS 432,512 A * 7/1890 Coughlin ..... D03D 51/28 139/353
652,223 A * 6/1900 Harriman ..... D03D 51/28 139/353

(Continued)

FOREIGN PATENT DOCUMENTS

CN 206376057 U * 8/2017 ..... D03D 51/28
CN 206376057 U 8/2017

(Continued)

OTHER PUBLICATIONS

French Search Report issued in French Application No. FR1903273 on Dec. 9, 2019 (2 pages).

(Continued)

*Primary Examiner* — Grace Huang
(74) *Attorney, Agent, or Firm* — Bookoff McAndrews, PLLC

(57) ABSTRACT

A weaving installation (400) comprises a loom (100) for making a woven texture by weaving between a plurality of threads, at least part of the plurality of threads being carbon threads (210, 211, 212, 213, 214, 215), the carbon threads each being individually stored on one bobbin of a plurality of carbon thread storage bobbins (220, 221, 222, 223, 224, 225) present upstream of the loom. The installation further comprises a plurality of pairs of first and second electrical contacts (301, 302; 303, 304; 305, 306; 307, 308; 309, 310; 311, 312) present between the storage bobbins (220, 221, 222, 223, 224, 225) and the loom (100). Each pair of first and second electrical contacts is present in the path of a carbon thread, the first and second contacts of each pair being intended to be in electrical contact with a given carbon thread. The contacts of each pair of first and second contacts are further connected to an open-circuit detection circuit (230).

9 Claims, 1 Drawing Sheet

(56) References Cited

U.S. PATENT DOCUMENTS 669,620 A * 3/1901 Clark ..... D03D 51/28 139/357
867,758 A * 10/1907 Sanford ..... D03D 51/00 139/354
1,139,994 A * 5/1915 O'Connell ..... D03D 51/28 139/357
1,311,788 A * 7/1919 Abbott ..... B65H 2701/31 242/475.1
1,486,483 A * 3/1924 Field ..... D01H 13/1625 340/677
2,148,700 A * 2/1939 Lohsse ..... D03D 51/08 139/336
2,569,475 A * 10/1951 Klein ..... D02H 13/00 361/170
2,586,373 A * 2/1952 Paul ..... D03D 51/28 139/341
2,764,367 A * 9/1956 Brey ..... D02H 13/00 318/7
3,360,914 A * 1/1968 Black, Jr. ..... D01H 13/005 57/1 R
3,378,998 A * 4/1968 Shackelford ..... D01H 11/005 15/301
4,361,172 A * 11/1982 Torii ..... D03D 51/34 139/371
4,839,815 A * 6/1989 Eaton ..... B65H 59/40 242/410
4,881,062 A * 11/1989 Makino ..... D02H 13/08 226/11
5,005,503 A * 4/1991 Trahan ..... B65H 63/0321 112/277
9,809,926 B2 * 11/2017 Oberste ..... D06M 15/53
11,401,635 B2 * 8/2022 Lohia ..... D03D 51/30
2005/0146076 A1 * 7/2005 Alexander ..... B29C 70/24 264/257

FOREIGN PATENT DOCUMENTS

CN 107881642 A 4/2018
GB 612072 A * 11/1948 ..... D03D 51/28
GB 626496 A * 7/1949 ..... D03D 51/28

OTHER PUBLICATIONS

International Search Report issued in International Application PCT/FR2020/050554 on Sep. 14, 2020 (4 pages).

* cited by examiner

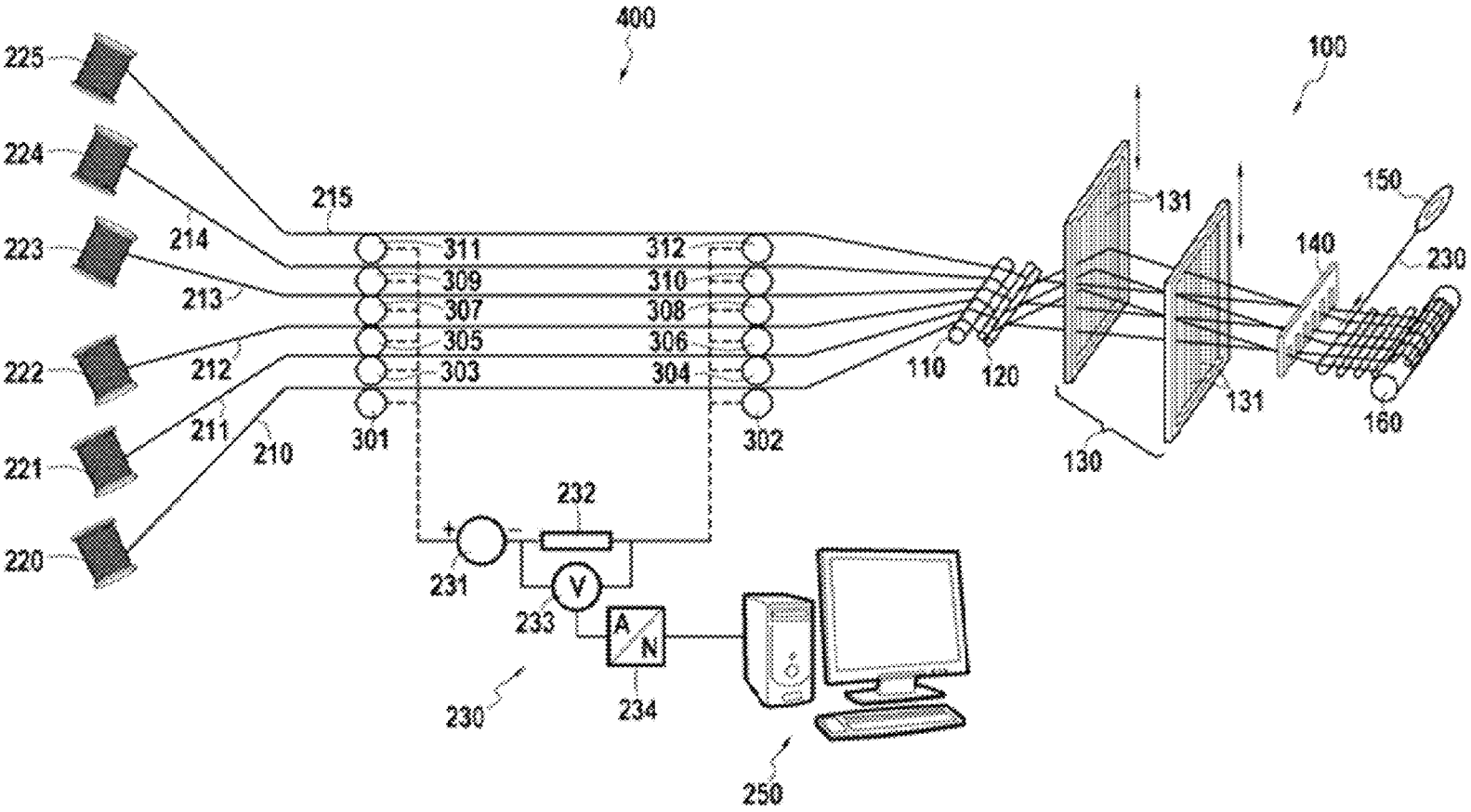
100
150
230
160
140
131
131
130
120
110
302
312
310
308
306
304
400
232
233
234
250
230
231
311
309
307
305
303
301
215
210
214
213
212
211
225
224
223
222
221
220

CONTROL OF THE POSITIONING AND CONTINUITY OF THREADS IN A LOOM

CROSS-REFERENCE TO RELATED APPLICATION(S)

This patent application is the U.S. National Stage entry under 35 U.S.C. § 371 of International Patent Application No. PCT/FR2020/050554, filed on Mar. 16, 2020, which claims the benefit of priority to French Patent Application No. 1903273, filed on Mar. 28, 2019.

TECHNICAL FIELD

The present invention relates to the field of looms and in particular those that use carbon fibers for the production of fibrous reinforcements of composite material components.

PRIOR ART

The preparation of the warp, also called warping, is a very tedious operation because it consists in placing each carbon thread one after the other in perforated boards to order the threads for weaving or in heddle eyes and to fix them with a thread calling system present at the exit of the loom. This operation is a source of errors because the number of carbon threads to be placed can be very high, for example more than a hundred, with a very small distance between each thread.

In addition, even with proper warp preparation, it is possible for one or more threads to break during weaving. The breakage of a carbon thread among all the warp threads is sometimes difficult to spot.

In any case, the incorrect placement of thread at the beginning or the breaking of a thread during weaving has major consequences because the fibrous reinforcement obtained does not have all the required mechanical characteristics, which leads to a risk of rejects and thus of waste of raw material.

DISCLOSURE OF THE INVENTION

Consequently, it is desirable to have a solution to monitor both the correct positioning and the integrity (continuity) of the carbon threads in a loom.

To this end, in accordance with the invention, there is provided a weaving installation comprising a loom for making a woven texture by weaving between a plurality of threads, at least part of the threads of the plurality of threads being carbon threads, the carbon threads each being individually stored on one bobbin of a plurality of carbon thread storage bobbins present upstream of the loom, characterized in that it comprises a plurality of pairs of first and second electrical contacts present between the storage bobbins and the loom, each pair of first and second electrical contacts being present in the path of a carbon thread, the first and second contacts of each pair being intended to be in electrical contact with a given carbon thread, the contacts of each pair of first and second contacts being further connected to an open-circuit detection circuit.

By virtue of a pair of electrical contacts present in the path of each thread, the weaving installation of the invention is able to monitor the preparation of the warp in the loom before weaving as well as the integrity of each warp thread during weaving. Indeed, concerning the preparation of the warp threads, if one or more of them are incorrectly positioned, the error is detected by the relevant open-circuit detection circuit(s), which allows the operator to correctly replace each incorrectly positioned thread before starting the loom. Similarly, if one or more warp threads break during weaving, this will be detected by the relevant open-circuit detection circuit(s) allowing immediate intervention.

According to a first particular feature of the weaving installation of the invention, the first and second electrical contacts of each pair of first and second contacts are present in the vicinity of a carbon thread storage bobbin and in the vicinity of the entrance to the loom, respectively. This covers most of the path of the warp threads before they enter the loom.

According to a second particular feature of the weaving installation of the invention, each contact of the plurality of pairs of first and second electrical contacts comprises a rotatable electrically conductive element, each electrically conductive element being intended to be in contact with a thread of the plurality of carbon threads. The wear on the threads as they pass over the electrical contacts is thus greatly reduced.

According to a third particular feature of the weaving installation of the invention, the latter further comprises a monitoring system connected to the open-circuit detection circuit, a control device being configured to issue a stop signal to the loom or an error signal in response to the detection of an open circuit between the electrical contacts of at least a pair of first and second electrical contacts. The system is thus capable of automatically controlling the loom in the event of an incident on one or more warp threads.

According to a fourth particular feature of the weaving installation of the invention, the open-circuit detection circuit is a low-voltage electrical circuit. This prevents the possible occurrence of arcing in the installation.

The invention also relates to a process for monitoring the positioning and continuity of carbon threads in a weaving installation in accordance with the invention comprising a loom for making a woven texture by weaving between a plurality of threads, at least part of the plurality of threads being carbon threads, the carbon threads each being individually stored on one bobbin of a plurality of carbon thread storage bobbins present upstream of the loom, characterized in that it comprises monitoring the presence of each carbon thread between the storage bobbins and the loom by detecting one or more open circuits.

The process of the invention makes it possible to monitor the correct positioning of the warp threads at the end of the warp preparation and to correct any positioning errors before the loom is started, thus ensuring a compliant weave. In addition, during weaving, the process of the invention makes it possible to detect the breakage of a warp thread in real time and thus to quickly apply a corrective measure if necessary.

According to a first particular feature of the weaving process of the invention, monitoring the presence of each carbon thread comprises connecting each carbon thread to an open-circuit detection circuit, the connection comprising making a first electrical contact on the carbon thread in the vicinity of a carbon thread storage bobbin and making a second electrical contact on the same carbon thread in the vicinity of the entrance to the loom.

According to a second particular feature of the weaving process of the invention, the engagement of the first and second electrical contacts is achieved with first and second rotatable electrically conductive elements, respectively.

According to a third particular feature of the weaving process of the invention, the latter further comprises stopping the loom or issuing an error signal in response to detecting the absence of a carbon thread between the storage bobbins and the loom.

According to a fourth particular feature of the weaving process of the invention, the open-circuit detection circuit is a low-voltage electrical circuit.

BRIEF DESCRIPTION OF THE DRAWINGS

FIG. 1 The single FIG. 1 is a schematic perspective view of a weaving installation according to an embodiment of the invention.

DESCRIPTION OF THE EMBODIMENTS

The invention applies generally to looms used to produce fibrous textures with carbon fiber threads, the threads being stored upstream of a loom in bobbins and unwound to the loom exit. The invention applies in particular to Jacquard-type looms used in particular to produce fibrous textures or fabrics by two-dimensional (2D) and three-dimensional (3D) or multilayer weaving between layers of warp threads and layers of weft threads.

FIG. 1 shows very schematically a weaving installation 400 according to an embodiment of the invention. The weaving installation 300 comprises a loom 100 warp-fed with carbon threads (threads composed of carbon fibers). For the sake of clarity, FIG. 1 illustrates only 6 carbon warp threads 210 to 215 each stored on 6 bobbins 220 to 225, respectively. The bobbins are stored in a rack, also called a creel (not shown in FIG. 1). Conventionally, the loom 100 comprises, from upstream to downstream, a first beam 110, a rod or bar 120 (which can be replaced by one or more hoppers), a harness 130, a reed 140, a shuttle or lance 150 and a second beam or roller 160 intended to call up the warp threads and wind up the woven texture. The harness 130 is provided with heddles 131 having eyes (not shown) through which the warp threads 210 to 215 pass, the heddles 131 being moved in an upward or downward direction so as to create a passage or shed in the axis of the path of the shuttle 150 intended for passing a weft thread 230.

In accordance with the invention, the weaving installation 400 further comprises a plurality of pairs of first and second electrical contacts present between the storage bobbins and the loom, the pairs of contacts forming part of a thread positioning and continuity monitoring system 300. More precisely, in the example described here, the system comprises 6 pairs of first and second electrical contacts 301 and 302, 303 and 304, 305 and 306, 307 and 308, 309 and 310, and 311 and 312, intended to be brought into electrical contact with the carbon warp threads 210, 211, 212, 213, 214 and 215, respectively. The first electrical contacts 301, 303, 305, 307 and 309 are preferably placed in the vicinity of the bobbins 220 to 225 while the second electrical contacts are preferably placed in the vicinity of the entrance to the loom 100 so as to cover the majority of the path of the warp threads prior to their weaving into the loom. Each pair of electrical contacts is connected to an open-circuit detection circuit described in greater detail below.

In the present invention, advantageous use is made of the conductive properties of the carbon fibers making up the carbon threads. Indeed, as the carbon fibers are composed of graphitic domains, they possess the electrical properties of graphite. Graphite is an anisotropic material with a very good electrical conductivity in the direction of the graphene planes. Since the graphitic domains are oriented in the longitudinal direction of the fibers, the latter have good thermal and electrical properties in the direction of the thread. The electrical resistivity of a fiber therefore decreases if its graphitic character increases, with values ranging from 900 μΩ·cm for a high-modulus fiber (350 to 500 GPa) to 1650 μΩ·cm for fibers with lower moduli (200 to 300 GPa).

Thus, the presence of each warp thread at the entrance of the loom can be continuously monitored (i.e., before and during weaving) by means of a pair of electrical contacts present in the path of each thread. The electrical contacts of each pair can be static, i.e., they each consist of a fixed element having a conductive surface on which the carbon thread slides. According to another feature of the invention, each electrical contact may be constituted by a rotatable electrically conductive element, which minimizes frictional forces on the carbon threads and reduces the risk of damage to said threads. As such, each contact of the plurality of pairs of first and second electrical contacts comprise a conductive element rotatable in contact with a carbon thread. In the example described here, the first and second electrical contacts 301 and 302, 303 and 304, 305 and 306, 307 and 308, 309 and 310, and 311 and 312 of each pair consist of a roller made of an electrically conductive metallic material such as copper. Thus, the movement of a carbon thread between its storage bobbin and the loom causes the two rollers forming the pair of first and second electrical contacts to rotate, thus maintaining permanent electrical contact with the carbon thread without wearing it down by friction. The rollers used here can be of the pulley or wheel type, optionally associated with a spring support in order to better monitor the electrical contact with the thread without exerting too much stress on it.

The thread positioning and continuity monitoring system comprises a plurality of open-circuit detection circuits that are each connected to a given pair of first and second electrical contacts.

For the sake of clarity, only one open-circuit detection circuit 230 is shown in FIG. 1, the circuit 230 being connected to the first and second electrical contacts 301 and 302 present in the path of the carbon thread 210. Five other open-circuit detection circuits are connected to pairs of first and second electrical contacts 303 and 304, 305 and 306, 307 and 308, 309 and 310, and 311 and 312, respectively.

The open-circuit detection circuit 230 comprises a voltage generator 231 associated in series with a resistor 232. The circuit 230 further comprises a voltmeter 233 connected in parallel with the resistor 232. The voltage measurement made by the voltmeter 233 is transmitted to a monitoring device 250, for example a computer, via an analog-to-digital converter 234.

The electrical contacts of each pair of contacts are used to loop the open-circuit detection circuit. In case of absence or loss of contact of a carbon thread with at least one electrical contact of a pair of electrical contacts, the circuit becomes open and the voltage aux measured by the voltmeter is zero.

The monitoring device 250 comprises a dedicated input for each voltage measurement signal provided by an identified open-circuit detection circuit to be able to determine which carbon thread is broken or incorrectly placed upon detection of an open circuit.

The open-circuit detection circuit 230 described above is only one example of an embodiment of such a circuit. The person skilled in the art will have no difficulty considering other structures for creating an open-circuit detection circuit.

If one or more open circuits are detected, the monitoring device can emit an error signal to alert an operator of the fault. The monitoring device can be further connected to the loom control device to send thereto a stop signal upon detection of an open circuit corresponding to the breaking of a carbon thread in order to stop weaving and minimize the loss of raw material.

The present invention makes it possible to monitor both the correct positioning of the threads before the loom is started and their integrity or continuity throughout the weaving process.

The invention claimed is:

1. A weaving installation comprising a loom including a plurality of threads, at least part of the plurality of threads being carbon threads, the carbon threads each being individually stored on one bobbin of a plurality of carbon thread storage bobbins present upstream of the loom, wherein the weaving installation comprises a plurality of pairs of first and second electrical contacts present between the carbon thread storage bobbins and the loom, each pair of first and second electrical contacts being present in a path of one of the carbon threads, the first and second electrical contacts of each pair configured to be in electrical contact state with one of the carbon threads, wherein each contact of the plurality of pairs of first and second electrical contacts comprises a conductive element rotatable when in the electrical contact state with a carbon thread of the plurality of carbon threads, and the contacts of each pair of first and second contacts being further connected to an open-circuit detection circuit, wherein the first and second electrical contacts of each pair are used to loop the open-circuit detection circuit so that in case of absence or loss of the electrical contact state of one of the carbon threads with at least one of the first and second electrical contacts, the circuit becomes open.

2. The installation as claimed in claim 1, wherein the first electrical contacts of the plurality of pairs of first and second electrical contacts are present in the vicinity of the plurality of carbon thread storage bobbins while the second electrical contacts of the plurality of pairs of first and second electrical contacts are present in the vicinity of the entrance of the loom.

3. The installation as claimed in claim 1, further comprising a monitoring system connected to the open-circuit detection circuit, said monitoring system being configured to issue a stop signal to the loom or an error signal in response to the detection of an open circuit between the electrical contacts of at least a pair of first and second electrical contacts.

4. The installation as claimed in claim 1, wherein the open-circuit detection circuit is a low-voltage electrical circuit.

5. A process for monitoring a positioning and continuity of carbon threads in the weaving installation as claimed in claim 1, comprising: monitoring a presence of each carbon thread between the storage bobbins and the loom by detecting one or more open circuits.

6. The process as claimed in claim 5, further comprising stopping the loom or issuing an error signal in response to detecting the absence of one of the carbon threads between the storage bobbins and the loom.

7. The process as claimed in claim 5, wherein the monitoring of the presence of each carbon thread comprises connecting each carbon thread to an open-circuit detection circuit, the connection comprising making each first electrical contact of the plurality of pairs of first and second electrical contacts on the carbon thread in a vicinity of the plurality of carbon thread storage bobbin and making each second electrical contact of the plurality of pairs of first and second electrical contacts on the same carbon thread in the vicinity of the entrance to the loom.

8. The process as claimed in claim 7, wherein the making of the first and second electrical contacts is achieved with first and second rotatable electrically conductive elements, respectively.

9. The process as claimed in claim 7, wherein the open-circuit detection circuit is a low-voltage electrical circuit.

* * * * *